United States Patent [19]

Creutz et al.

[11] 4,101,387

[45] Jul. 18, 1978

[54] COMPOSITION FOR ELECTRODEPOSITION OF METAL DEPOSITS, ITS METHOD OF PREPARATION AND USES THEREOF

[75] Inventors: Hans-Gerhard Creutz, Yale; Roy Wilbur Herr, Troy; Richard Marshall Stevenson, Grosse Point Woods, all of Mich.

[73] Assignee: Oxy Metal Industries Corporation, Warren, Mich.

[21] Appl. No.: 603,563

[22] Filed: Aug. 11, 1975

Related U.S. Application Data

[63] Continuation-in-part of Ser. No. 462,683, Apr. 22, 1974, abandoned.

[51] Int. Cl.[2] ..... C25D 3/56; C25D 3/12; C25D 3/22; C25D 3/20

[52] U.S. Cl. ..... 204/43 T; 204/48; 204/49; 204/55 R; 204/DIG. 2

[58] Field of Search ..... 204/49–55, 204/DIG. 2, 43 T, 48

[56] References Cited

U.S. PATENT DOCUMENTS

| | | | |
|---|---|---|---|
| 3,472,743 | 10/1969 | Rushmere | 204/55 Y |
| 3,671,304 | 6/1972 | Mischutin | 428/254 |
| 3,723,263 | 3/1973 | Rosenberg | 204/55 R |
| 3,956,078 | 5/1976 | Kardos et al. | 204/52 R |

*Primary Examiner*—F.C. Edmundson
*Attorney, Agent, or Firm*—B. F. Claeboe; Richard P. Mueller; Arthur E. Kluegel

[57] ABSTRACT

The instant invention is directed to an aqueous bath for the electrodeposition of bright metal deposits, and more particularly to a bath composition which provides upon the basis metal an electrodeposit having improved brightness, particularly in low current density areas, and as well, a condition of ductility markedly better than that which characterizes certain prior art baths. The electroplating bath composition of this invention embodies a polyethylenimine having the general empirical formula $-[C_2H_5N]_x-$, and a sulfonating agent for the polyethylenimine, whereby there is obtained a reaction product which contains nitrogen substituted sulfamate groups as an integral part of the polymer chain. The nitrogen substituted sulfamate unit of the reaction product is represented by the formula:

$$-[CH_2CH_2\underset{\underset{SO_3^{\ominus}M^{\oplus}}{|}}{N}]-$$

where, M = H, Li, Na, K, or, $NH_4$. The ratio of these nitrogen substituted sulfamate units to amino units, $-[CH_2CH_2NH]-$, in the reaction product is determined by the molar ratio of the polymer repeat unit, $-[C_2H_5N]-$, to sulfonating agent in the reaction.

5 Claims, No Drawings

COMPOSITION FOR ELECTRODEPOSITION OF METAL DEPOSITS, ITS METHOD OF PREPARATION AND USES THEREOF

CROSS REFERENCE TO RELATED CASES

This application is a continuation-in-part of U.S. application Ser. No. 462,683 filed Apr. 22, 1974, and now abandoned.

BACKGROUND OF THE INVENTION

It is known in the art to which this invention pertains to electrodeposit upon a basis metal a metallic material exemplified by zinc, copper, nickel or the like utilizing in the electroplating bath polyamines as one of the additives thereto. Polyamines having the property of enhancing the brightness and also contribute to grain refinements of the deposit. However, polyamines are relatively potent or active and can cause embittlement of the cathode deposit, and contribute to a relatively poor bond between the metal substrate and the electroplate.

The literature is also replete with references to the utilization in a zinc plating bath containing polyvinyl alcohol, an aromatic aldehyde and a chelating agent, however, experience has indicated that under normal bath conditions the polyvinyl alcohol tends to accumulate and rise to a relatively high concentration in the bath, and among other contributing difficulties, it has been found that certain aromatic aldehydes may at times be in relatively short supply.

The prior art which has endeavored to deal with the problems above set forth are U.S. Pat. Nos. 2,451,426; 3,317,412; 3,594,291; and 3,694,330, as well as German Patent No. 1,521,029. However, applicants have found that when these teachings of the prior art are followed there is not obtained a product having the requisite degree of brightness, particularly in the low current density areas, nor can the desired degree of ductility be at all times expected.

SUMMARY OF THE INVENTION

It has been found that by proceeding in accordance with the present inventive concepts bright zinc, iron-nickel, and other electrodeposits can be produced without resort to compounds such as polyvinyl alcohol, aromatic aldehydes and chelating agents, by substituting therefor the reaction product of a polyethylenimine and sulfonating agent. Equally importantly, the deficiencies of utilizing solely polyamines is overcome when nitrogen substituted sulfamate groups are introduced into the polyethylenimine chain, apparently producing thereby some weakness in the relatively strong cationic nature of the polyamine.

Nitrogen substituted sulfamates are broadly defined as N-sulfonated amines with the general formula $R_1R_2$ N-$SO_3X$, wherein $R_1$ = alkyl, aryl; $R_2$ = alkyl, aryl, H; and X = H, Na, K, Li, $NH_4$ or other metal ion.

A known method of preparation of nitrogen substituted sulfamates involves the reaction of amines with sulfur trioxide ($SO_3$) or its compounds or derivatives. Typical of these sulfonating agents are sulfur trioxide ($SO_3$), chlorosulfuric acid ($ClSO_3H$), sulfamic acid ($NH_2SO_3H$), and various amine, ether, or thioether complexes of sulfur trioxide.

A second method of preparation involves the reaction of certain nitrogen-containing organic compounds such as nitro, nitroso, or hydroxylamino groups with sulfur dioxide or its compounds. However, this is not at present a generally accepted method and accordingly has limited practical value.

The reaction of a primary or secondary amine with sulfamic acid to form a nitrogen substituted sulfamate involves two steps. First, the amine salt of sulfamic acid is formed; $R_1R_2NH + NH_2SO_3H \rightarrow NH_2SO_3^- H_2N^+ R_1R_2$ and then, in a thermal rearrangement step, the ammonium salt of the nitrogen substituted sulfamate is formed, thusly; $NH_2SO_3^-H_2N^+ R_1R_2 \rightarrow R_1R_2N\text{-}SO_3^-NH_4^+$. It is of course known that formation of the amine salt may occur in aqueous solution, but the thermal rearrangement step to form the nitrogen substituted sulfamate cannot occur in aqueous solution.

In the preparation of the reaction product of a polyethylenimine having a molecular weight of about 1200 and sulfamic acid, the amount of sulfamic acid used is theoretically sufficient to sulfamate two-thirds of the available primary and secondary amino groups in the polymer.

To 86 grams of polyethylenimine (mol.wt. 1200) heated to 70° C there was added 96 grams of sulfamic acid in portions over a 1 hour period with the temperature held at 70°-85° C. The vigorously stirred reaction mixture was slowly heated to 160° C for 1 hour, held at 150°-160° C for 2 hours, cooled to 125° C and quenched by addition of 275 ml. of hot water. The mixture was stirred at reflux until solution was complete to give a 40% solution.

The N-sulfonation of polyethylenimine with other sulfonating agents has also been accomplished as is demonstrated by the examples now to follow.

To a reaction flask fitted with a calcium chloride drying tube there was added 200 ml. of dry dioxane and the flask cooled to 0° C in an ice-brine bath. Chlorosulfuric acid (10 ml.) was added keeping the temperature below 10° C. Then a suspension of 4.3 grams of polyethylenimine (mol. wt. 1200) in 100 ml. of dry dioxane was added, keeping the temperature below 10° C. The reaction mixture was slowly warmed to 70° C, then the solvent was decanted. The white polymeric residue was washed with ether then dissolved in 100 ml. of water.

To a reaction flask connected to a gas absorption trap there was added 150 ml. of methylene chloride. The flask was cooled to −10° C in an ice-brine bath and 40 grams of sulfur trioxide was carefully added in small portions. While stirring rapidly a solution of 21.5 grams of polyethylenimine (mol. wt. 600) in 200 ml. of methylene chloride was added, keeping the temperature between −10° C and 0° C. After the addition was completed the reaction mixture was allowed to warm to room temperature and then heated in a water bath to 80° C, allowing the methylene chloride to evaporate. The mixture was dissolved in 200 grams of ice water.

The polyethylenimine of this invention has the general empirical formula $-[C_2H_5N]-_x$, wherein $x$ is a numeral from 4 to 20,000, and more preferably a MW in the range of about 300 to not more than approximately 1800, and in combination with the sulfonating agent for the polyethylenimine there is obtained a reaction product which contains nitrogen substituted sulfamate groups as an integral part of the polymer chain. The nitrogen substituted sulfamate unit of the reaction product is represented by the formula:

$$-[CH_2CH_2\underset{\underset{SO_3^{\ominus}M^{\oplus}}{|}}{N}]-$$

where, M = H, Li, Na, K, or $NH_4$. The ratio of these nitrogen substituted sulfamate units to amino units, —[$CH_2CH_2NH$]—, in the reaction product is determined by the molar ratio of the polymer repeat unit —[$C_2H_5N$]—, to sulfonating agent in the reaction.

DESCRIPTION OF THE PREFERRED EMBODIMENT

Applicants' invention is directed to the electrodeposition of bright zinc, iron-nickel and other metallic materials utilizing in the metal finishing bath a water soluble polyelectrolyte containing nitrogen substituted sulfamate and amino groups and more particularly a polyethylenimine including nitrogen substituted sulfamate groups. More particularly, the polyethylenimine has the general emperical formula set forth above, and when reacted with a sulfonating agent has the general chemical composition described hereinabove. Desirably, when a polyethylenimine is reacted with a sulfonating agent the molar ratio of the polymer repeat unit, —[$C_2H_5N$]—, to the sulfonating agent may vary from about 1 to 1 to 2 to 1.

The invention will first be described more fully in connection with generally known zinc sulfate, zinc fluoborate and zinc chloride plating baths, however, the advantageous results achieved from the standpoint of brightness and ductility will be further pointed out when reference is made to nickel and nickel-iron plating baths.

EXAMPLE I

A plating bath was formulated incorporating therein 187 grams per liter of zinc sulfate monohydrate, 23 grams per liter of boric acid and 0.1 to 1 grams per liter of a N-sulfonated polyethylenimine. The pH of the bath was about 4.0 and when utilizing a current density of about 40 amperes per square foot, there was obtained a zinc plate which was noted to be between semi-bright and bright.

EXAMPLE II

Another bath was prepared utilizing 300 grams per liter of zinc fluoborate and 0.1 to 1 grams per liter of a N-sulfonated polyethlenimine. In this test the pH of the bath was about 3.5 and the current density approximately 50 ASF. This produced a zinc plate which is characterized as semi-bright to bright.

EXAMPLE III

A zinc chloride plating bath was prepared utilizing an aqueous solution of 40 grams per liter of zinc chloride, and 200 grams per liter of ammonium chloride. The bath pH was about 5.0, and as in the previous examples, there was employed relatively pure zinc anodes, steel cathodes, and a plating time of about 20 minutes. In this example the current density was about 30 ASF and there was obtained from the bath a rather course and dull deposit. However, when there was added to a bath of the same composition 5cc per liter of about 40 percent N-sulfonated polyethylenimine solution, the deposits obtained were very bright.

As was stated above, the novel concepts of this invention are also applicable to the electrodeposition of bright iron-nickel alloy deposits. Preferably, a deposit of this character contains from 5 to 50% by weight iron, and as an optimum, about 15 to about 35% by weight which can be used as the basis for subsequent electrodeposition of chromium in order to impart desirable decorative and/or corrosion properties to substrates, such as metallic substrates.

The additive composition, bath and process of the present invention can also be used in the electrodeposition of metallic finishing materials for plastics. Normally the plastic substrate such as acrylonitrile-butadiene-styrene, polyethylene, polypropylene, polyvinyl chloride, phenol-formaldehyde polymers and the like is pretreated by applying a conductive metallic deposit such as nickel or copper onto the plastic substrate. The zinc, nickel, nickel-iron or other deposit may then be used as a subsequent coating upon the conductive metallic deposit.

In order to introduce iron and nickel ions into the bath, any bath soluble iron or nickel containing compound may be employed provided that the corresponding ion is not detrimental to the bath. Preferably inorganic nickel salts are employed, such as, nickel sulfate, nickel chloride, and the like as well as other nickel materials such as nickel sulfamate. When nickel sulfate salts are used, they are normally present in amounts ranging from 40 to 300 grams per liter (calculated as nickel sulfate .$6H_2O$ ); nickel chloride may also be used and is present in an amount ranging from about 80 to 250 grams per liter. The chloride or halide ions are employed in order to obtain satisfactory conductivity of the solution and at the same time to impart satisfactory corrosion properties to the soluble anodes.

Preferably the inorganic salts of iron are employed, such as, ferrous salts exemplified by ferrous sulfate, ferrous chloride and the like. These salts are preferably present in an amount ranging from about 3 to 60 grams per liter. Other bath soluble iron salts may be employed, as for example soluble ferrous fluoborate or sulfamate.

The iron complexing agent employed in the present invention is one that is bath soluble and contains complexing groups selected from the group consisting of carboxy and hydroxy provided that at least one of the complexing groups is a carboxy group and further that there are at least two complexing groups present. The complexing agent that may be employed is present in an amount ranging from about 10 to about 100 grams per liter. Suitable complexing agents are hydroxy substituted lower aliphatic carboxylic acids having from 2 to 8 carbon atoms, from 1 to 6 hydroxyl groups and from 1 to 3 carboxyl groups such as, ascorbic acid, isoascorbic acid, citric acid, malic acid, glutaric acid, gluconic acid, muconic, glutamic, glucoheptonate, glycollic acid, aspartic acid and the like, as well as amine containing complexing agents, such as nitrilotriacetic acid, ethylene diamine tetra-acetic acid, or the water soluble salts thereof such as ammonium and the alkali metal salts such as potassium, sodium, lithium, and the like. It will also be appreciated that the iron may be introduced into the bath as a salt of the complexing agent.

By "carboxy" is meant the group —COOH. However, it is to be appreciated that in solution, the proton disassociates from the carboxy group and therefore this group is encompassed within the meaning of carboxy.

The purpose of the complexing agent is to keep the metal ions, in particular, the ferrous and ferric ions in solution. It has been found that as the pH of a normal Watts nickel plating bath increases above a pH of 3.0, ferric ions tend to precipitate as ferric hydroxide. The complexing agent prevents the precipitation from taking place and therefore makes the iron and nickel ions available for electrodeposition from the complexing agent.

While the iron is always introduced as the ferrous salt, it has been established that a portion of the iron in solution is almost always oxidized from the ferrous to ferric state. The concentration of ferric ion in solution is determined by a number of factors, and particularly by the operating pH of the solution. The type and amount of anode area in the solution will also affect the relative concentration of ferric ion. We believe this may be due to the oxidizing of ferrous to ferric ion at the anode. Generally speaking, it is found that at least 5% of the total iron in solution is present as ferric ions, and it is preferred that the ferric ion not exceed 30 to 40% of the total iron in the bath, although it has been established in work performed to date that acceptable results may be obtained when even as much as 60% of the iron in the solution is present as ferric ions. It has been observed that the relative concentration of ferric ion will be higher in an air agitated solution than one that is dependent on only cathode agitation. The exact structure which is formed by the interaction of the ferric ion with the complexing agent is not presently precisely known. The literature reports a number of possible structures under different conditions; for instance, the structure reported in water solution may be different from that determined in biological applications. We also have reason to believe that the structure in a plating solution changes during electrolysis. Regardless of the exact structure, the ferric ion is not precipitated from the solution, as the hydroxide, even at a pH of 5.

Because of the operating parameters employing the complexing agent, the pH of the bath preferably ranges from about 2.5 to about 5.5 and even more preferably about 3 to about 4.6. The temperature of the bath generally ranges from about 120° F to about 180° F, preferably about 160° F. The average cathode current density varies from about 10 to about 70 amps per square foot and preferably about 45 amps per square foot. While the bath may be operated without agitation, various means of agitation may be employed such as mechanical agitation, air agitation, cathode rod movement and the like.

It is preferred that the complexing agent concentration be at least three times the total iron ion concentration in the bath. The complexing agent concentration ratio to total iron ion concentration may range from about 3 to 50 to 1.

The bath may also contain various buffers such as boric acid and sodium acetate and the like ranging in amounts from about 30 to 60 grams per liter, preferably 40 grams per liter. The ratio of nickel ions to iron ions generally ranges from about 5 to about 50 to 1.

It has also been found that various nickel brightening additives may be employed to impart brightness ductility and leveling to the iron nickel deposits. Suitable additives which may be used are the sulfo oxygen compounds such as those described as brighteners of the first class described in *Modern Electroplating*, published by John Wiley and Sons, Second Edition, Page 272.

The amount of sulfo-oxygen compounds employed in the present invention may range from about 0.5 to about 10 grams per liter. It has been found that saccharin may be used in amounts ranging from 0.5 to about 5 grams per liter and which results in a bright ductile deposit. When other sulfo-oxygen compounds are employed, such as, naphthlenetrisulfonic, sulfobenzaldehyde and dibenzenesulfonamide, good brightness is obtained; however, the ductility is not nearly as good as with saccharin. In addition to the above sulfo-oxygen compounds that may be used, others which are suitable are sodium allyl sulfonate, benzene sulfinates, vinyl sulfonate, beta-styrene sulfonate, and cyano alkane sulfonates (having from 1 to 5 carbon atoms).

The bath soluble sulfo-oxygen compounds that may be used in the present invention are those such as the unsaturated aliphatic sulfonic acids, mononuclear and binuclear aromatic sulfonic acids, mononuclear aromatic sulfinic acids, mononuclear aromatic sulfonamides and sulfonimides, and the like.

To illustrate the invention further, a number of examples will be given generally utilizing a nominal solution composition as follows:

| | |
|---|---|
| $NiSO_4 \cdot 6H_2O$ | 75 g/l |
| $NiCl_2 \cdot 6H_2O$ | 75 g/l |
| $H_3BO_3$ | 45 g/l |
| $FeSO_4 \cdot 7H_2O$ | 10 g/l |
| $C_3H_6(OH)\ COONa$ | 14 g/l |
| $C_3H_4(OH)\ (COONa)_3$ | 6 g/l |
| Saccharin | 3 g/l |
| Sodium Allyl Sulfonate | 5.4 g/l |
| pH | 3.4 |
| Temperature | 150° F |
| Air Agitation | |

EXAMPLE IV

To the solution composition set forth above there was added a polyamine having a molecular weight of about 600 which had been reacted with propane sultone. This reaction product when added at a concentration range of approximately 2 to 12 milligrams per liter produced a deposit having exceptionally good brightness and leveling.

EXAMPLE V

To the bath solution as set forth above, there was added N-sulfonated polyethylenimine obtained by reacting a polyethylenimine having a molecular weight of about 1200 with sulfamic acid, at a concentration of about 8 milligrams per liter, together with approximately 45 milligrams per liter of 2-propynoxy ethanol. Again, excellent brightness and leveling were obtained in the nickel-iron deposit.

In order to demonstrate the markedly improved results obtained when the reaction products herein disclosed are utilized in a typical Watts nickel bath and the nickel-iron bath which comprises nickel and iron ions and the iron complexing agent disclosed in Example IV, baths were formulated in which both the Watts and nickel-iron formulations were utilized with agitation at 145° F. To each solution there was added 2 grams per liter of saccharin and 4 grams per liter of allyl sulfonate. Steel panels were plated in each solution at 45 ASF for 10 minutes at various concentrations of the reaction product of polyethylenimine, having a molecular weight of 1200, and propargyl epichlorohydrin.

In the Watts nickel bath the polyethylenimine-propargyl adduct was varied in concentration from 2 milligrams per liter, 4 milligrams per liter, 8 milligrams per liter, 16 milligrams per liter and 25 milligrams per liter. At the lower concentrations of 2, 4 and 8 milligrams per liter the deposit was overall semi-bright with no leveling, while at concentrations of 16 and 25 milligrams per liter the deposit was lustrous with some slight leveling. However, when the mentioned nickel-iron bath was utilized, the addition of 2 milligrams per liter of the polyethylenimine-propargyl adduct revealed a deposit which could be characterized as overall lustrous to bright with some leveling, the addition of 4 milligrams per liter gave an overall bright deposit with fair leveling, and when 8 milligrams per liter of the adduct was added marked improvements were noted in that the deposit was essentially totally bright and excellent leveling was obtained.

These same tests were repeated utilizing the propane sultone adduct of polyethylenimine at a molecular weight of about 1800. With the Watts nickel bath additions of the mentioned adduct at concentrations of 2, 4, 12 and 24 milligrams per liter produced only an overall semi-bright deposit with essentially no leveling. Quite by contrast, in the disclosed nickel-iron previously described, when 2 milligrams per liter of the polyethylenimine propane sultone adduct was added, the deposit was lustrous to bright with some leveling, 4 milligrams per liter produced an overall bright deposit with rather fair leveling, 8 milligrams per liter gave an overall bright deposit with good leveling, and when 12 milligrams per liter of the adduct was employed, the deposit was very bright and the leveling was excellent.

To further illustrate the novel effects accomplished when the disclosed procedures of the instant invention are followed, and in order to point out the structural dissimilarities between the teachings of the prior art as exemplified by U.S. Pat. No. 3,671,304 granted June 20, 1972, two polyethylenimine derivatives were prepared which resulted in first a polyethylenimine salt of sulfamic acid wherein the polyethylenimine had a molecular weight of 1200, and also a salt of sulfamic acid in which the polyethylenimine had a molecular weight of 60,000. Quite by contrast, the compound of the instant invention is best described as an alkyl sulfamic acid derivative of polyethylenimine whose molecular weight is approximately 1200. In all the tests there was employed 500cc air agitated cells containing 30 grams per liter of saccharin and 5 grams per liter of sodium allyl sulfonate at a temperature of about 145° F at a pH of approximately 3.5. The panel tests performed with polished steel panels plated at 45 ASF for 10 minutes clearly indicated that the compounds of the prior art gave poor adhesion and had much darker recesses than that which was obtained from a solution containing the compound of the instant invention. Panels obtained when the procedures of the prior art were followed showed substantial blistering under stress conditions, while like panels when plated in accordance with this invention showed no cracking or blistering.

It would thus appear that the polyethylenimine derivatives have little or limited effectiveness in nickel plating solutions while deposits of great brightness and outstanding leveling can be obtained with these same compounds in nickel-iron solutions of the type described. As has also been pointed out in Example V, when propargyl alcohol derivatives are used in conjunction with polyethylenimine derivatives, particularly certain N-sulfonated polyethylenimines, the low current density leveling is further improved, and as a result, exceptionally fine nickel-iron deposits are obtained with a level equally as good as, and in some cases, even exceeding what are recognized in the art to be the best bright nickel baths.

The secondary brighteners, or acetylenic nickel brighteners, are generically propargyl alcohol derivatives having the formula $CH{\equiv}C-CH_2-O-X$, wherein X is essentially the reactive functional group. More particularly, the structural formula may be typified as follows:

$HC{\equiv}C-CH_2-X$ wherein X may be $OR_1$, or $N(R_2)(R_3)$

If $X = OR_1$, $R_1$ may be $[-CH_2CH_2-O]_n$ or $R_1$ may be $[-CH_2-C(CH_2OH)(OH)]_n$ or $R_1$ may be $[-CH_2-CH_2(CH_2Cl)-]_n$ or $R_1$ may be $[-CH_2C(CH_2SO_3H)(OH)]_n$ ($K^+$, $Li^+$, $Na^+$, $NH_4^+$) and the like or $R_1$ may be $[-CH_2-CH(OH)-CH_2-]_n$ or $R_1$ may be $[-CH_2-C(CH_2-N(R_4)(R_5))(OH)-]_n$ wherein $R_4$ or $R_5$ may be H, alkyl, alkene or alkyne groups of 1 to 4 carbon atoms;

wherein n = 0 to 3; and if $X = N(R_2)(R_3)$ $R_2$ or $R_3$ may be H, alkyl, alkene or alkyne groups of 1 to 4 carbon atoms.

To further illustrate the invention, two stock solutions were prepared which are designated herein below as nickel bath A and nickel-iron bath B:

| NICKEL BATH (A) | |
|---|---|
| Nickel Sulfate | 300 g/l |
| Nickel Chloride | 45 g/l |
| Boric Acid | 40 g/l |
| Saccharin | 3.0 g/l |
| Allyl Sulfonate | 4.5 g/l |
| pH | 3.8 |

| NICKEL-IRON BATH (B) | |
|---|---|
| Nickel Sulfate | 108 g/l |
| Nickel Chloride | 82 g/l |
| Boric Acid | 44 g/l |
| Gluconic Acid (Sodium Salt) | 25 g/l |
| Ferrous Sulfate | 15 g/l |
| Saccharin | 3.0 g/l |
| Allyl Sulfonate | 4.5 g/l |

-continued

| | NICKEL-IRON BATH (B) |
|---|---|
| pH | 3.3 |

The nickel solution A was divided into several 600cc air agitated plating cells and various propargyl alcohol derivatives were tested. Rolled steel cathode panels 1½ by 6 inches were used for the tests. Results are given in the following Table No. I. All panels were plated at 45 ASF for 10 minutes.

Solution B was also divided into several 600cc air agitated plating cells and the tests were repeated. Results are given in Table No. II.

Another portion of plating solution B was placed in a 4 liter air agitated plating cell. 2 by 9 inch S shaped steel cathode panels were used to determine the low current density leveling of the bath. The panels were plated at 35 ASF for 10 minutes. Results are given on Table No. III.

It would thus appear than when propargyl alcohol, and its derivatives, are used in simple nickel plating baths there is obtained to a degree good brightness and leveling, if used in combination with typical sulfo-oxygen "carrier type" brighteners. However, these compounds are rather critical with respect to concentration in that the amount needed in order to achieve even good brightness and leveling will produce dark recesses, skipped plate, poor adhesion and striated deposits. As a result, these compound must be used in trace amounts of the order of 10 milligrams per liter or less in the nickel plating bath in combination with other less critical brightening agents, in order to minimize their adverse effects. However, limiting the concentration of these materials, their effectiveness with respect to leveling and brightness is markedly limited.

TABLE I

| | | SOLUTION A | |
|---|---|---|---|
| COMPOUND TESTED | CONCENTRATION | BATH TEMPERATURE | RESULTS |
| 2-propynoxy ethanol | 20 mg/l | 145° F | Bright leveled, striated deposit with a dark low current density area and poor adhesion |
| 2-propynoxy ethanol | 40 mg/l | 145° F | Very bright leveled deposit with a black misplated low current density area; severe striation and exfoliation |
| 2 hydroxy 3 propynoxy-1-propane sulfonate | 20 mg/l | 145° F | Bright fairly leveled deposit with low current density area striation |
| 2 hydroxy 3 propynoxy-1-propane sulfonate | 40 mg/l | 145° F | Bright leveled deposit, striated and slight misplate in the low current density area |
| 1-propynoxy-3-chloro-2-propanol | 80 mg/l | 145° F | Bright leveled deposit, severe striation, and a misplate in the low current density area |
| 1-propynoxy-2-propanol | 20 mg/l | 145° F | Bright leveled, striated deposit with a dark low current density area |
| 1-propynoxy-2-propanol | 40 mg/l | 145° F | Very bright leveled deposit with severe striations, poor adhesion and a dark misplate in the low current density area |

TABLE II

| | | SOLUTION B | |
|---|---|---|---|
| COMPOUND TESTED | CONCENTRATION | BATH TEMPERATURE | RESULTS |
| 2 propynoxy ethanol | 20 mg/l | 150° F | Bright leveled smooth deposit with an excellent low current density area |
| 2 propynoxy ethanol | 40 mg/l | 150° F | Very bright leveled smooth deposit with an excellent low current density area |
| 2 propynoxy ethanol | 80 mg/l | 150° F | Extremely bright leveled smooth deposit with an excellent low current density area |
| 2 hydroxy 3 propynoxy-1-propane sulfonate | 40 mg/l | 150° F | Bright leveled smooth deposit with an excellent low current density area |
| 1 propynoxy-3 chloro-2 propanol | 120 mg/l | 150° F | Very bright leveled smooth deposit with an excellent low current density area |
| 1 propynoxy-2-propanol | 80 mg/l | 150° F | Extremely bright leveled smooth deposit with an excellent low current density area |

TABLE III

| COMPOUND TESTED | CONCENTRATION | BATH TEMPERATURE | RESULTS |
|---|---|---|---|
| (1) 2-propynoxy ethanol | 60 mg/l | 150° F | Very bright and smooth with excellent overall leveling and good low current density area leveling |
| (2) As above with 0.4 mg/l of a N-sulfonated polyethylenimine | | | Same as above except that there was a noticeable improvement in the low current density area leveling |

Quite by contrast, when these compounds are used in the disclosed iron-nickel plating bath their adverse effects are virtually non-existant even at extremely high concentrations. The test described indicated that as high as 80 milligrams per liter of the most critical derivative, that is, 2 propynoxy ethanol at a 1 to 1 mole ratio produces bright, uniform, and exceptional leveling with good adhesion and excellent recessed areas. As little as 15 milligrams per liter of this material in a bright nickel bath using the same sulfo-oxygen carriers produced striated deposits with dark skipped recess areas and poor adhesion.

Tests also indicated that as little as 20 mg/l of 2-propynoxy alcohol plus 0.13 mg/l of a N-sulfonated polyethylenimine, obtained by the reaction of polyethylenimine (MW 1200) and sulfamic acid in a mole ratio of the polymer repeat unit, —$[C_2H_5N]$—, to sulfamic acid of 2 to 1 in combination with saccharin and allyl sulfonate produced noticeably better overall brightness and leveling in Bath B above described than Bath A containing the maximum amount of secondary brightener addition agents as described in Table I.

It is believed manifest from the foregoing that applicants have provided a novel composition of matter, electroplating bath and method of electrodeposition which provides markedly improved results by way of brightness and excellent leveling in both the high and low current density areas. This is quite in contrast with the results obtained in conventional zinc, nickel, and related baths. While a number of variations in the formulae have been disclosed herein, these changes and others may of course be practiced without departing from the spirit of the invention or the scope of the subjoined claims.

What is claimed is:

1. A composition of matter for use in an aqueous bath for the electrodeposition of bright metal deposits selected from the group consisting of nickel, nickel-iron and zinc, which comprises a reaction product of a polyethylenimine having the general empirical formula —$[C_2H_5N]_x$—, and a sulfonating agent of said polyethylenimine, whereby there is obtained a reaction product which contains nitrogen substituted sulfamate groups as an integral part of the polymer chain, said nitrogen substituted sulfamate unit of the reaction product being represented by the formula:

$$-[CH_2CH_2\underset{\underset{SO_3^{\ominus}M^{\oplus}}{|}}{N}]-$$

where M=H, Li, Na, K, or $NH_4$, the ratio of said nitrogen substituted sulfamate units to amino units, —$[CH_2CH_2NH]$—, in the reaction product being determined by the molar ratio of the polymer repeat unit —$[C_2H_5N]$—, to sulfonating agent in the reaction.

2. A composition of matter as defined in claim 1, wherein the molar ratio of nitrogen substituted sulfamate units to amino units varies from about 1 to 1 to 2 to 1.

3. A composition of matter for use in an aqueous bath for the electrodeposition of bright metal deposits selected from the group consisting of nickel, nickel-iron and zinc, which comprises a reaction product of a polyethylenimine having the general empirical formula —$[C_2H_5N]_x$—, and a sulfonating agent selected from the group consisting of a sulfamic acid, chlorosulfuric acid and sulfur trioxide, the mole ratio of the polymer repeat unit —$[C_2H_5N]$—, to sulfamic acid being approximately 2 to 1, the mole ratio of polymer repeat unit —$[C_2H_5N]$— to chlorosulfuric acid being approximately 1 to 1, and the mole ratio of polymer repeat unit —$[C_2H_5N]$—, to sulfur trioxide being in the range of 1 to 1 to 2 to 1, the molecular weight of the polyethylenimine varying from not less than about 300 to not more than approximately 1800.

4. A process for electrodepositing a bright metallic finish selected from the group consisting of nickel, nickel-iron and zinc upon a substrate, comprising passing a current through an aqueous acidic bath including a polyelectrolyte, in which the polyelectrolyte is a reaction product of a polyethylenimine and a sulfonating agent which contains nitrogen substituted sulfamate groups as a integral part of the polymer chain, said nitrogen substituted sulfamate unit of the reaction product is represented by the formula:

$$-[CH_2CH_2\underset{\underset{SO_3^{\ominus}M^{\oplus}}{|}}{N}]-$$

where M=H, Li, Na, K, or $NH_4$, the ratio of said nitrogen substituted sulfamate units to amino units —$[CH_2CH_2NH]$— in the reaction product being determined by the molar ratio of the polymer repeat unit —$[C_2H_5N]$— to sulfonating agent in the reaction.

5. A process for electrodepositing a bright metallic finish selected from the group consisting of nickel, nickel-iron and zinc upon a substrate, comprising passing a current through an aqueous acidic bath including a polyelectrolyte in which the polyelectrolyte is a polyethylenimine having the general empirical formula —$[C_2H_5N]_x$— and a compound selected from the group consisting of sulfamic acid, chlorosulfuric acid and sulfur trioxide, the mole ratio of the polymer repeat unit —$[C_2H_5N]$— to sulfamic acid being about 2 to 1, the mole ratio of the polymer repeat unit —$[C_2H_5N]$— to chlorosulfuric acid being approximately 1 to 1, and the mole ratio of polymer repeat unit —$[C_2H_5N]$— to sulfur trioxide being in the range of 1 to 1 to 2 to 1, the molecular weight of the polyethylenimine varying from not less than about 300 to not more than approximately 1800.

* * * * *